US005488758A

United States Patent [19]

Tahara et al.

[11] Patent Number: 5,488,758

[45] Date of Patent: Feb. 6, 1996

[54] SLIVER PIECING METHOD

[75] Inventors: Ryosuke Tahara, Kyoto; Yoshihisa Inoue, Ibaraki, both of Japan

[73] Assignee: Murata Kikai Kabushiki Kaisha, Kyoto, Japan

[21] Appl. No.: 329,187

[22] Filed: Oct. 26, 1994

[30] Foreign Application Priority Data

Oct. 29, 1993 [JP] Japan ..... 5-293881

[51] Int. Cl.[6] ..... D01H 15/00

[52] U.S. Cl. ..... 19/150; 19/144; 19/260; 28/117

[58] Field of Search ..... 19/144, 145, 150, 19/260; 28/117, 103, 150

[56] References Cited

U.S. PATENT DOCUMENTS 2,286,817 6/1942 Knight ..... 28/120 X
2,495,420 1/1950 Popper et al. ..... 28/120 X
3,397,695 8/1968 Voss ..... 19/144 X
5,058,241 10/1991 Haigh et al. ..... 19/150
5,140,722 8/1992 Akiyama ..... 19/150
5,177,835 1/1993 Ogawa et al. ..... 19/150 X
5,359,758 11/1994 Stahlecker et al. ..... 19/150 X

*Primary Examiner*—John J. Calvert
*Attorney, Agent, or Firm*—Armstrong, Westerman, Hattori, McLeland & Naughton

[57] ABSTRACT

The present invention relates to a sliver piecing method wherein sliver piecing is performed with yarn incorporated in an overlapped portion of sliver ends and since yarn having a suitable thickness is incorporated in an overlapped portion of sliver ends and in this state the sliver piecing operation is performed, it is possible to surely detect and remove spun yarn obtained from such sliver overlapped portion, using a yarn clearer.

4 Claims, 3 Drawing Sheets

SLIVER PIECING METHOD

BACKGROUND OF THE INVENTION

1. Field of the Invention

The present invention relates to a sliver piecing method for piecing end portions of sliver which has broken during supply to a spinning machine or for piecing together an end portion of sliver being fed to a spinning machine from an empty can and an end portion of sliver contained in a full can when a certain can in a row of sliver-containing cans arranged behind the spinning machine has become almost empty (such a can will hereinafter be referred to simply as "empty can") and when the empty can is to be replaced with a can full of sliver (such a can will hereinafter be referred to as "full can").

2. Prior Art

Heretofore, there has been known a sliver piecing method wherein, when sliver has broken or when an empty can is to be replaced with a full can, sliver ends are overlapped together and then the overlapped portion is rubbed together for piecing.

When sliver after piecing by the conventional sliver piecing method involving overlapping sliver ends and rubbing together the overlapped portion is fed to a spinning machine, e.g. spinning frame, spun yarn from the sliver overlapped portion becomes thicker or thinner, depending on overlapping conditions, in comparison with the other portion.

In the presence of such a sliver overlapped portion, when the draft ratio is high as in a spinning frame, spun yarn having a diameter difficult to be detected by a yarn clearer, e.g. slub catcher, is usually produced over several meters or several ten meters.

If spun yarn having such a thin or thick portion incapable of being detected by a yarn clearer over several or several ten meters is used in the production of such product as woven or knitted fabric, the said thin or thick portion will form a band-like weaving defect or knitting defect, thus resulting in deteriorated product value.

Heretofore, however, there has not been known a sliver piecing method capable of surely removing spun yarn obtained from a sliver overlapped portion at the time when the spun yarn is obtained.

SUMMARY OF THE INVENTION

It is the object of the present invention to solve the above-mentioned problem of the conventional sliver piecing method and provide a sliver piecing method capable of detecting spun yarn obtained from a sliver overlapped portion positively by using a yarn clearer such as a slub catcher.

According to the present invention, in order to achieve the above-mentioned object, sliver piecing is performed while a yarn is incorporated in an overlapped portion of sliver ends.

Spun yarn from such sliver pieced portion with the yarn incorporated therein comes to have a thickness capable of being detected by a yarn clearer and hence it is possible to surely detect spun yarn having a thickness which causes formation of a weaving defect or knitting defect.

DETAILED DESCRIPTION OF PREFERRED EMBODIMENTS

Figure 1:
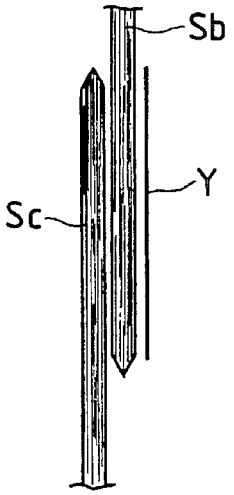
FIG. 1 is an enlarged side view of a sliver overlapped portion.
Figure 2:
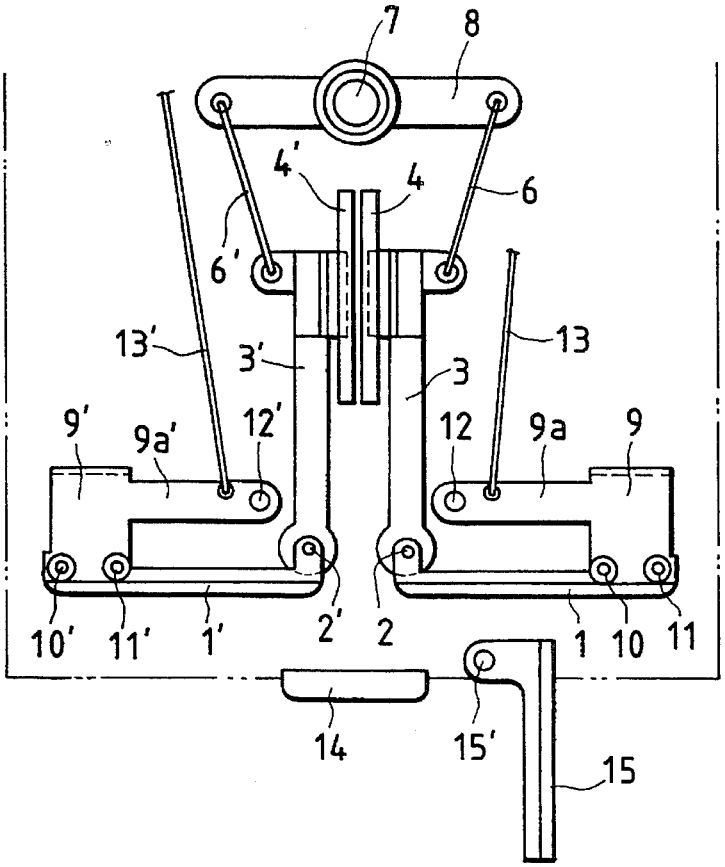
FIG. 2 is a plan view showing a principal portion of a sliver piecing apparatus as an example of practicing the sliver piecing method of the present invention.
Figure 3:
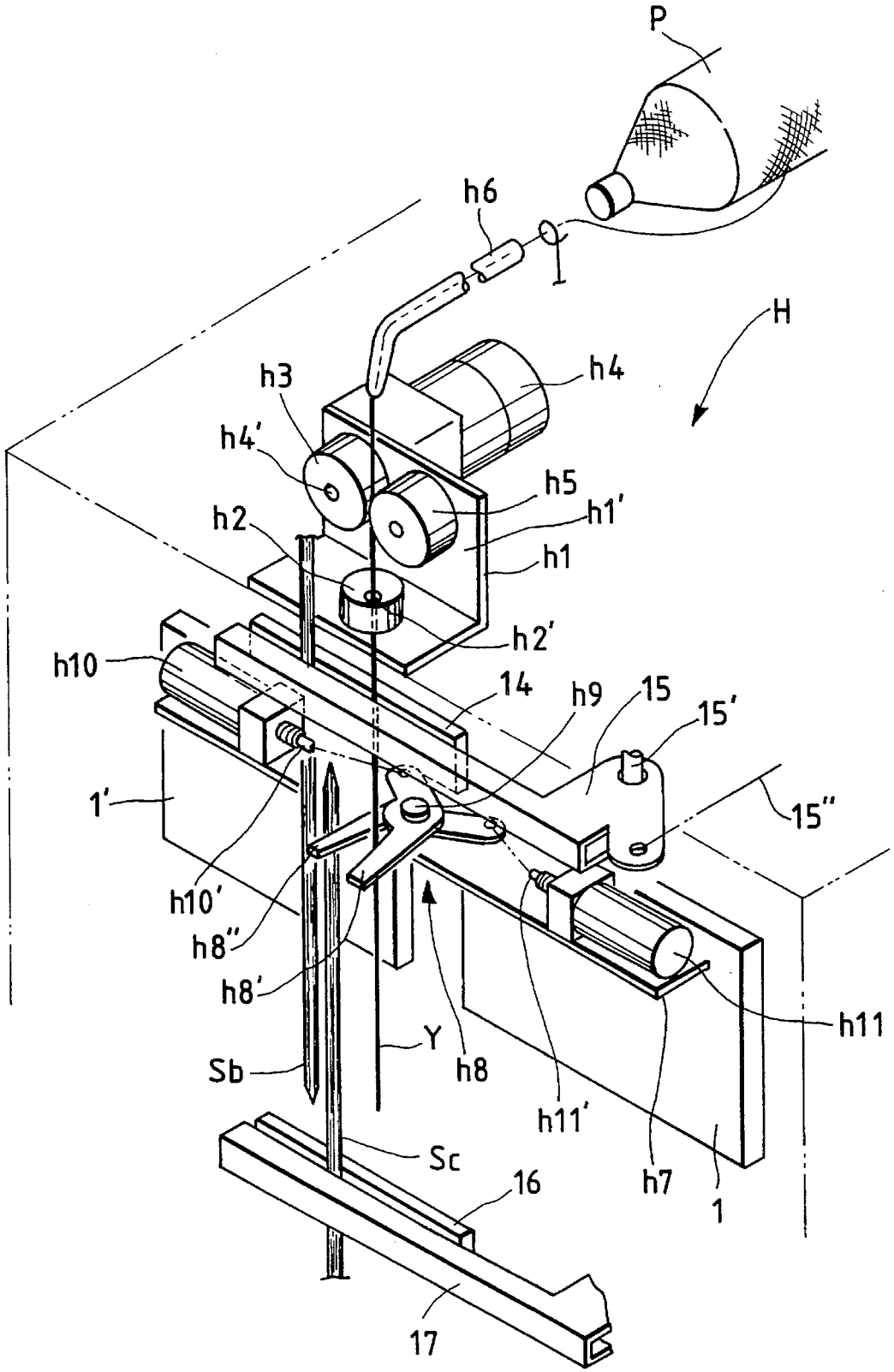
FIG. 3 is an enlarged perspective view of a principal portion of the sliver piecing apparatus.

The present invention will be described below with reference to FIG. 1 which is an enlarged side view of a sliver overlapped portion for explaining the sliver piecing method of the invention, FIG. 2 which is a plan view showing a principal portion of a sliver piecing apparatus as an example of practicing the sliver piecing method of the invention, FIG. 3 which is an enlarged perspective view of a principal portion of the sliver piecing apparatus and FIG. 4 which, like FIG. 3, is also an enlarged perspective view of a principal portion of the sliver piecing apparatus. It is to be understood that, within the scope not departing from the gist of the present invention, no limitation is made to the following embodiment.

The reference mark Sb denotes an end portion of broken sliver on a spinning frame side, and Sc denotes an end portion of broken sliver on a can side. Upon breakage of sliver, as shown in FIG. 1, the end portions Sb and Sc are partially overlapped or arranged side by side (merely "overlapped" hereinafter) and this overlapped portion or juxtaposed portion ("overlapped portion" hereinafter) is rubbed together, thereby causing the constituent fibers of the sliver end portions Sb and Sc to get entangled and cohere to piece both end portions together.

According to the present invention, when the broken sliver ends Sb and Sc are to be partially overlapped together, a yarn Y having predetermined thickness and length is superimposed on or put in parallel with the overlapped portion and is then rubbed together with the end portions Sb and Sc to piece both end portions.

Figure 4:
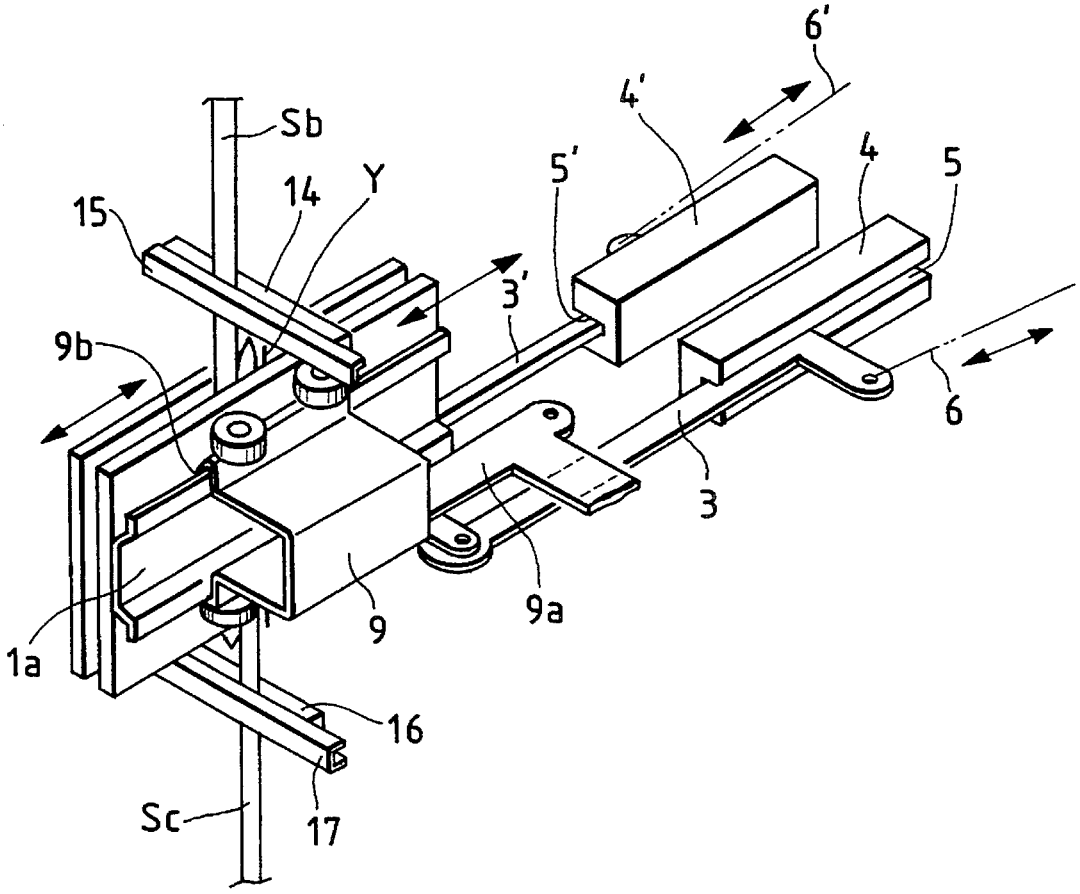
FIG. 4 is an enlarged perspective view of a principal portion of the sliver piecing apparatus like FIG. 3.

The following description is now provided about an example of a sliver piecing apparatus for practicing the sliver piecing method of the present invention with reference to FIG. 2 which is a plan view of a principal portion of the sliver piecing apparatus, FIG. 3 which is an enlarged perspective view of a principal portion of the sliver piecing apparatus and FIG. 4 which, like FIG. 3, is also an enlarged perspective view of a principal portion of the apparatus.

The numerals 1 and 1' each denote a plate-like piecing member. The piecing members 1 and 1' are pivotally connected to slide members 3 and 3' through pins 2 and 2', respectively, and are urged in directions opposite to each other by means of suitable spring members such as coiled springs or the like (not shown) disposed around the pins 2 and 2'.

Numerals 4 and 4' each denote a guide block. The slide members 3 and 3' are fitted in guide slots 5 and 5' formed in the guide blocks 4 and 4', respectively.

Numerals 6 and 6' each denote a rod. One end of the rods 6 and 6' are connected to end portions of the slide members 3 and 3', respectively, on the side opposite to the pivotally mounted side of the piecing members 1 and 1', while the opposite ends thereof are connected to both end portions of a lever 8 which is pivotably mounted at a middle part thereof on a vertical shaft 7. By moving the lever 8 pivotally in a predetermined angular range about the vertical shaft 7, using a suitable drive means, the slide members 3 and 3' are caused to slide alternately vertically in FIG. 2 along the guide slots 5 and 5' formed in the guide blocks 4 and 4', so that the piecing members 1 and 1' connected pivotally to the slide members 3 and 3' can be reciprocated also alternately vertically.

Numerals 9 and 9' denote presser members disposed behind the piecing members 1 and 1', respectively. The presser members 9 and 9' are constructed so as to press the piecing members 1 and 1' through a suitable number of rollers 10, 11 and 10', 11' mounted to the presser members 9 and 9', respectively, and so as to be pivotable about vertical shafts 12 and 12', respectively.

The provision of such rollers 10, 11, 10' and 11' on the presser members 9, 9' permits a smooth rubbing contact of the piecing members 1 and 1'.

One ends of rods 13 and 13' are connected to front end portions of horizontal levers 9*a* and 9*a'* of the presser members 9 and 9', respectively, while the opposite ends thereof are connected to known cam means or the like (not shown). When the rods 13 and 13' are pulled down in FIG. 2, the presser members 9 and 9' move pivotally toward each other, or vertically in the same figure, about the vertical shafts 12 and 12'.

With such pivotal movement of the presser members 9 and 9', the presser members 9 and 9' cause the piecing members 1 and 1' to move pivotally in mutually contacting directions about the pins 2 and 2' through the rollers 10, 11, 10' and 11', thereby gripping the yarn Y and sliver ends Sb, Sc which are located between the piecing members 1 and 1'.

Thereafter, by moving the lever 8 pivotally about the vertical shaft 7, using a suitable drive means, the slide members 3 and 3' are allowed to slide alternately vertically in FIG. 2 along the guide slots 5, 5' formed in the guide blocks 4 and 4', so that the piecing members 1 and 1' connected pivotally to the slide members 3 and 3' are also reciprocated vertically in an alternate manner, whereby the yarn Y and the sliver ends Sb, Sc are rubbed and pieced together.

Although the presser members 9, 9' and the piecing members 1, 1' may be kept in abutment with each other merely through rollers 10, 11, 10' and 11', there also may be adopted a construction wherein, as shown in FIG. 4, slots 9*b* are formed by folding back end portions of the presser member 9 and end portions of a guide plate 1*a* disposed on the back side of the piecing member 1 are fitted in the slots 9*b*. In this case, the piecing members 1 and 1' can be supported positively by the presser members 9 and 9' at the time of their rubbing contact.

Numeral 14 denotes an upper clamp base and numeral 15 denotes an upper pivotable clamp which is pivotable about a pin 15'. The upper pivotable clamp 15 is moved pivotally about the pin 15' by means of a rod 15" connected pivotally to an end portion of the upper pivotable clamp 15 and can clamp the sliver end Sb in cooperation with the upper clamp base 14.

Numeral 16 denotes a lower clamp base. The lower clamp base 16 can clamp the sliver end Sc in cooperation with a lower pivotable clamp 17 which is pivotable like the upper pivotable clamp 15.

Description is now directed to a yarn inserting device H disposed in the sliver piecing apparatus mainly with reference to FIG. 3.

Numeral h1 denotes a frame which is disposed above the upper clamp base 14 and which is generally L-shaped. On the frame h1 is mounted a yarn guide member h2 having a through hole h2' for insertion of the yarn Y therein and having a conical upper surface.

Numeral h3 denotes a driving roller mounted on a driving shaft h4' of a motor h4 capable of feeding the yarn Y by a constant length, e.g. step motor, the driving shaft h4' extending through a vertical wall h1' of the generally L-shaped frame h1. Numeral h5 denotes a driven roller which is pivotally secured to the vertical wall h1' of the frame h1 and which is in abutment with the driving roller h3.

The yarn Y can be delivered a predetermined amount to the position between the underlying piecing members 1 and 1' by gripping it with both driving roller h3 and driven roller h5 and then driving the motor h4 to rotate the driving roller h3.

Numeral h6 denotes a guide pipe for guiding the yarn Y, which is delivered from a package P with the yarn Y wound thereon, up to a position near the yarn nipping point between the driving and driven rollers h3, h5.

Numeral h7 denotes a frame disposed between the piecing members 1, 1' and the upper clamp base 14. A cutter member h8 which constitutes a yarn cutting device is mounted on the frame h7. One cutter blade h8' of the cutter member h8 is pivotally secured to a pin h9 erected on the frame h7, and an end portion of the cutter blade h8' is connected to a rod h10' which can be protruded and retracted by means of an actuator h10 such as a hydraulic cylinder or the like disposed on the frame h7.

Another cutter blade h8" is also pivotally secured to the pin h9 erected on the frame h7, and an end portion of the cutter blade h8" is connected to a rod h11' which can be protruded and retracted by means of an actuator h11 such as a hydraulic cylinder or the like disposed on the frame h7.

Therefore, by operating the actuators h10 and h11, the cutter blades h8' and h8" can be moved in both opening and closing directions pivotally about the pin h9.

The sliver piecing process will be described below.

First, as shown in FIG. 3, in an opened state of the piecing members 1 and 1' and in order for the tip of the can-side sliver end portion Sc to be griped by the piecing members 1, 1', the lower pivotable clamp 17 is moved pivotally to clamp the sliver end portion Sc between the clamp 17 and the lower clamp base 16.

Likewise, in order for the tip of the spinning frame-side sliver end portion Sb to be gripped by the piecing members 1, 1', the upper pivotable clamp 15 is moved pivotally to clamp the end portion Sb between the clamp 15 and the upper clamp base 14.

Then, by driving the motor h4 to rotate the driving roller h3, the yarn Y gripped by the driving and driven rollers h3, h5 is delivered a predetermined amount to the position between the underlying piecing members 1 and 1'.

At this time, the yarn Y which is delivered by both driving and driven rollers h3, h5 is sure to be positioned between the piecing members 1 and 1', by means of a yarn guide member h2 having the through hole h2' and having a conical upper surface.

Thereafter, as mentioned previously, by pulling the rods 13 and 13' downward in FIG. 2, the presser members 9 and 9' are moved pivotally toward each other, or vertically in the same figure, so that the piecing members 1 and 1' move pivotably toward each other about the pins 2 and 2' to grip the yarn Y and the sliver end portions Sb, Sc located between both piecing members 1 and 1'.

Then, by operating the actuators h10 and h11, the cutter blades h8' and h8" are pivotally moved about the pin h9 and closed to cut the yarn y above the piecing members 1 and 1'.

Next, by moving the lever 8 pivotally about the vertical shaft 7, using a suitable drive means, the slide members 3 and 3' are allowed to slide alternately along the guide slots 5 and 5' formed in the guide blocks 4 and 4', as shown in FIG. 4, so that the piecing members 1 and 1' connected pivotally to the slide members 3 and 3' are also reciprocated in an alternate manner, whereby the yarn Y and the sliver end portions Sb, Sc which are gripped by the piecing members 1 and 1' are rubbed and pieced together.

After the piecing of the overlapped portion of both ends Sb and Sc with the yarn Y incorporated therein is over, the upper and lower pivotable clamps 15, 17 are pivotally moved and opened to release the clamp of Sb and Sc, and at the same time the piecing members 1, 1', etc. are returned to their original stand-by positions. In this way one cycle of the sliver piecing operation is completed.

In place of the cutter member h8 operated by the actuators h10 and h11 there may be adopted any of various known yarn cutters, such as, for example, a rotary cutter which is operated by a rotary solenoid or the like.

The length of a yarn incorporated in the overlapped portion of the sliver ends is preferably shorter than the shortest distance among the distance between the draft rollers in the draft part of a spinning machine. That is, the yarn having such length and having been incorporated in the sliver ends is never drafted by the draft rollers. The diameter of the yarn incorporated in the sliver ends is determined according to the yarn count to be spun and a predetermined sensitivity of a detector of yarn defects (a yarn clearer). If the sensitivity of the detector of yarn defects is set to be 120% (that is, when the detector detects a yarn having thickness of 1.2 times that of a yarn to be spun, the detector judges the yarn is defective one and cuts the yarn), and if the incorporating yarn has a thickness of 200% of that of a yarn to be spun, a yarn portion spun from the pieced sliver ends can be surely detected.

Although an example of application of the sliver piecing method of the present invention to a spinning frame has been described above, it is apparent that the said method is applicable also to a roving frame, etc. Further, the method of the present invention is applicable to various textile machines requiring the piecing of sliver such as a spinning frame which utilizes fluid.

Since the present invention is constructed as above, there is attained the following effect.

Since the sliver piecing operation is performed with a yarn of a suitable thickness incorporated in the overlapped portion of sliver ends, it is possible to surely detect and remove spun yarn obtained from such sliver overlapped portion, using a yarn clearer.

What is claimed is:

1. A sliver piecing method for piecing a sliver end on a spinning machine side and a sliver end on a new can side with each other, the method comprising positively incorporating a yarn of predetermined thickness and length in a parallel manner with overlapped portions of sliver and rubbing the yarn and sliver together to piece the sliver ends together.

2. A sliver piecing method according to claim 1, further comprising providing an apparatus for piecing a sliver end on a spinning machine side and a sliver end on a new can side with each other, the apparatus comprising:

a pair of piecing members supported to be able to contact with each other;

slide members connected to the piecing members and for reciprocating the piecing members alternately so that a yarn and the sliver ends are rubbed and pieced together by the piecing members;

an upper clamp means for clamping an end of a sliver;

a lower clamp means for clamping an end of another sliver; and a yarn inserting device including a yarn delivering means for gripping a yarn and delivering a predetermined length of yarn to the position between the piecing members and a cutter means for cutting the yarn disposed between the piecing members and the upper clamp means.

3. A sliver piecing method as claimed in claim 2, wherein presser members are disposed behind the piecing members, said presser member being constructed so as to press the piecing member through a plurality of rollers mounted to the presser member.

4. A sliver piecing method as claimed in claim 2, wherein said yarn inserting device further includes a yarn guide member having a through hole for insertion of the yarn and having a conical upper surface.

* * * * *